US008302787B2

(12) United States Patent
Tobey et al.

(10) Patent No.: US 8,302,787 B2
(45) Date of Patent: Nov. 6, 2012

(54) MEDICINE CONTAINER CARRIER

(76) Inventors: James S. Tobey, Shreveport, LA (US); Noelle B. Tobey, Shreveport, LA (US); Robert M. Baker, Shreveport, LA (US); Karen B. Baker, Shreveport, LA (US)

( * ) Notice: Subject to any disclaimer, the term of this patent is extended or adjusted under 35 U.S.C. 154(b) by 389 days.

(21) Appl. No.: 12/462,448

(22) Filed: Aug. 4, 2009

(65) Prior Publication Data

US 2011/0031199 A1 Feb. 10, 2011

(51) Int. Cl.
*A47B 73/00* (2006.01)

(52) U.S. Cl. ..... 211/77

(58) Field of Classification Search ..... 211/77, 211/74, 70, 78, 95, 115, 131.1, 144, 163, 211/129.1
See application file for complete search history.

(56) References Cited

U.S. PATENT DOCUMENTS 469,216 A * 2/1892 Quinn ..... 211/77
514,322 A * 2/1894 Iske et al. ..... 211/77
516,454 A * 3/1894 Sherman et al. ..... 312/135
663,046 A * 12/1900 Schaeffer ..... 211/163
1,728,512 A * 9/1929 Sharp ..... 211/77
1,759,140 A * 5/1930 Silberger ..... 211/77
1,974,735 A * 9/1934 Botham ..... 211/77
2,121,711 A * 6/1938 Patts ..... 211/77
2,946,456 A * 7/1960 Liguori ..... 211/77
3,417,873 A * 12/1968 Leptrone ..... 211/77
4,438,853 A * 3/1984 Numbers ..... 211/77
6,308,838 B1 * 10/2001 Endean ..... 211/37
6,439,406 B1 8/2002 Duhon ..... 211/131.1
6,500,666 B1 * 12/2002 Clements-Macak et al. ..... 435/303.3
6,585,119 B2 * 7/2003 Palder ..... 211/49.1
7,083,070 B2 * 8/2006 McGuyer ..... 222/144
7,748,545 B2 * 7/2010 Johnson ..... 211/78
2002/0170868 A1 * 11/2002 Morgan ..... 211/77
2004/0104188 A1 * 6/2004 Russell et al. ..... 211/78
2010/0089848 A1 * 4/2010 Thompson ..... 211/77

* cited by examiner

*Primary Examiner* — Jennifer E. Novosad
(74) *Attorney, Agent, or Firm* — John M. Harrison

(57) ABSTRACT

A medicine container carrier includes an carrier base, a medicine container carousel having multiple container cavities provided in the carrier base and multiple container engaging assemblies provided on the medicine container carousel at the container cavities, respectively.

7 Claims, 8 Drawing Sheets

MEDICINE CONTAINER CARRIER

FIELD

The present disclosure relates generally to medicine containers. More particularly, the present disclosure relates to a medicine container carrier which is suitable for the organization, storage, coordination and transport of medicine containers according to type of medication, dosage, scheduling and/or other parameters.

BACKGROUND

Medication and healthcare supplements in the form of capsules, tablets or pills is typically contained in elongated, cylindrical medicine containers fitted with a removable cap. A label may be provided on the exterior of the medicine container to indicate the type of medication as well as the indications or dosage of the medication in the container. In some cases, multiple types of medication may be prescribed to a patient at a given time, in which case it is necessary for the patient to keep track of which medications have and have not been taken over the course of each day. This task can be difficult, particularly under circumstances in which the patient must take some medications once or twice and other medications three or more times daily.

Patients' failure to take prescription medications according to the correct schedules or dosages is a significant challenge in treating illnesses. The average length of stay in hospitals due to medication noncompliance is 4.2 days. Twenty-three percent of nursing home admissions is due to patients' failure to take prescription medications accurately. Missed or improperly-taken medications cause an estimated 125,000 deaths each year.

Therefore, a medicine container carrier which is suitable for the organization, storage and transport of medicine containers according to type of medication, dosage, scheduling and/or other parameters is needed to enhance a patient's ability to prepare and take oral medications reliably and safely, increasing medication compliance.

SUMMARY

The present disclosure is generally directed to a medicine container carrier. An illustrative embodiment of the medicine container carrier includes an carrier base, a medicine container carousel having multiple container cavities provided in the carrier base and multiple container engaging assemblies provided on the medicine container carousel at the container cavities, respectively.

BRIEF DESCRIPTION OF THE DRAWINGS

The disclosure will now be made, by way of example, with reference to the accompanying drawings, in which.

DETAILED DESCRIPTION

Figure 1:
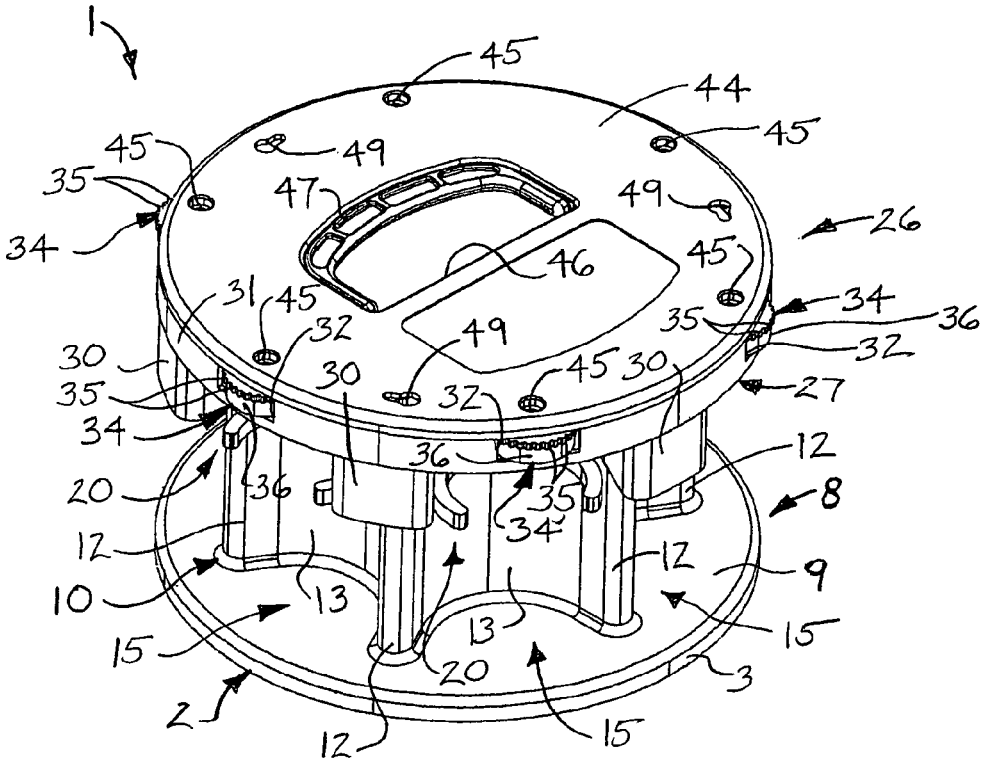
FIG. 1 is a perspective view of an illustrative embodiment of the medicine container carrier.
Figure 2:
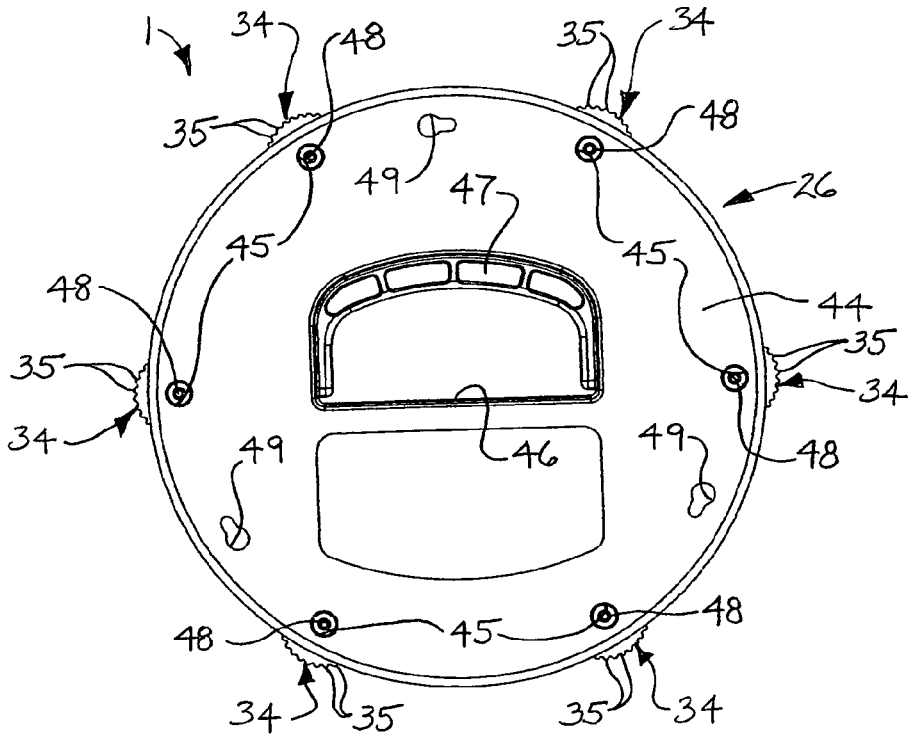
FIG. 2 is a top view of an illustrative embodiment of the medicine container carrier.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Referring initially to FIGS. 1-3A of the drawings, an illustrative embodiment of the medicine container carrier is generally indicated by reference numeral 1. As will be hereinafter described, the medicine container carrier 1 is adapted to receive one or multiple medicine containers 50 (FIGS. 3 and 3A), each of which contains medication (not illustrated) typically in the form of capsules, tablets or pills, for the purpose of organizing, transporting and storing the medicine containers 50 according to such parameters as the type, dosage and administration scheduling of the medication in each of the medicine containers 50. The medicine container carrier 1 displays the medicine containers 50 in a manner in which the medicine containers 50 are easily identifiable by and accessible to a patient or patient caregiver (not illustrated). Accordingly, the medicine container carrier 1 aids the patient or caregiver in identifying and coordinating the types, times and dosages of the medications in the respective medicine containers 50, thereby improving the patient's compliance in administration of the correct medications at the corresponding prescribed times and dosages and reducing medication errors.

Figure 3:
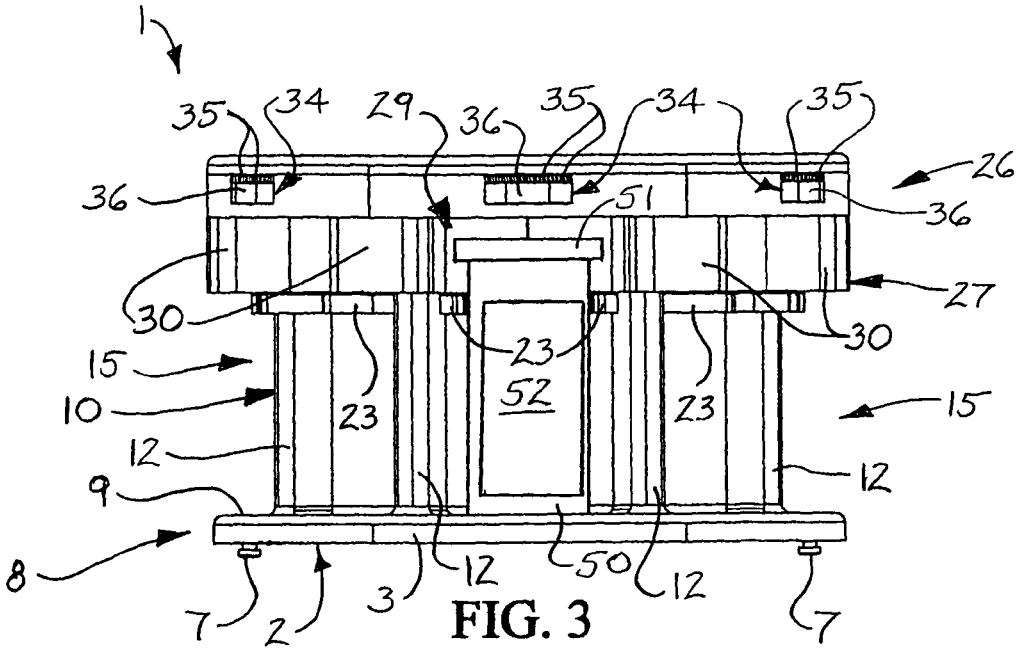
FIG. 3 is a side view of an illustrative embodiment of the medicine container carrier.
Figure 4:
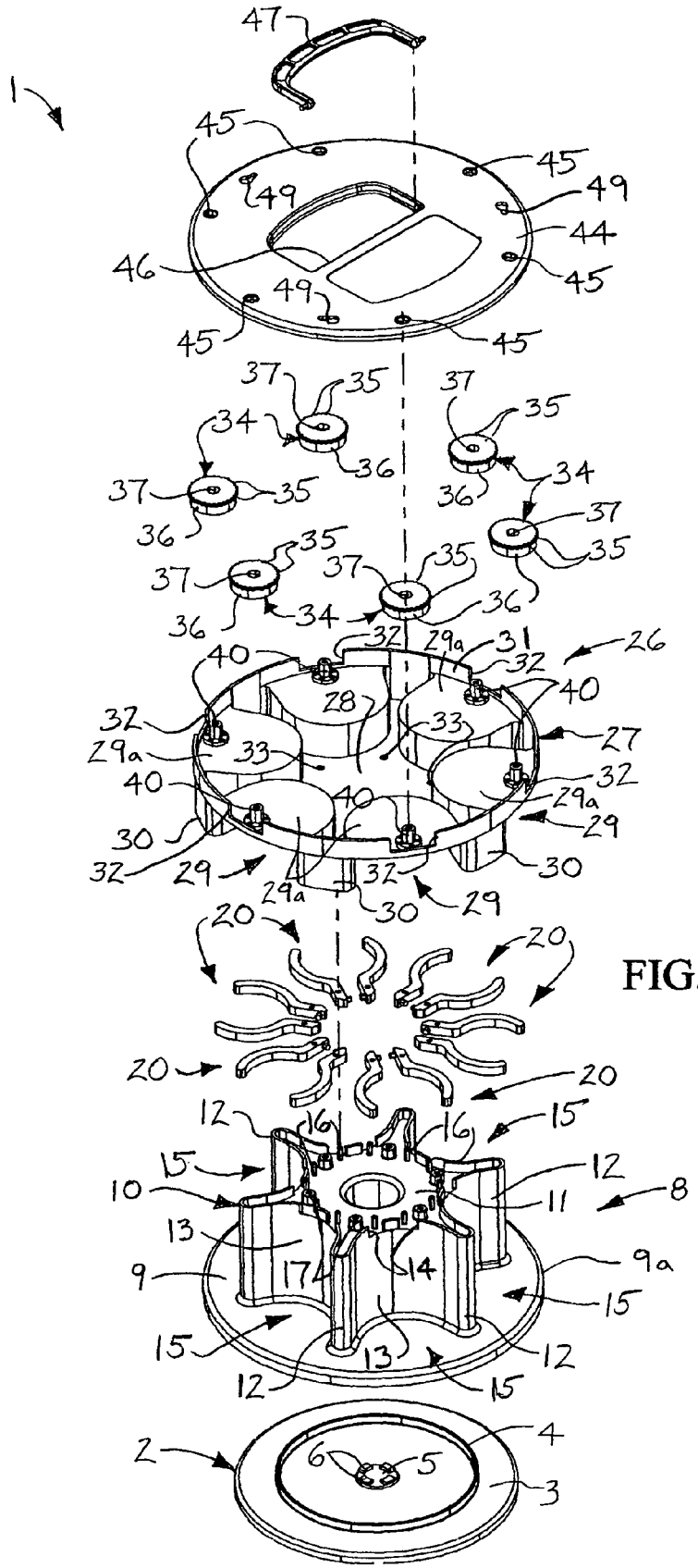
FIG. 4 is an exploded perspective view of an illustrative embodiment of the medicine container carrier.

Referring next to FIG. 4 of the drawings, an illustrative embodiment of the medicine container carrier 1 is illustrated in exploded view. The medicine container carrier 1 includes an carrier base 2. A medicine container carousel 8 may be provided on the carrier base 2. In some embodiments, the medicine container carousel 8 may be rotatable with respect to the carrier base 2 such as in a manner which will be hereinafter described. The medicine container carousel 8 may include a carousel base 9 which may be attached to the carrier base 2 in a manner which will be hereinafter described. A carousel body 10 may be provided on the carousel base 9. Multiple container cavities 15 are provided in the carousel body 10 in spaced-apart, adjacent relationship with respect to each other generally around the circumference of the carousel base 9. In use of the medicine container carrier 1, which will be hereinafter described, each container cavity 15 of the carousel body 10 is adapted to receive a corresponding medicine container 50, as illustrated in FIG. 3.

In some embodiments, the carousel body 10 may include multiple container cavity partitions 12 which extend upwardly from the carousel base 9 and protrude outwardly toward the edge 9*a* of the carousel base 9. Concave or recessed partition connecting walls 13 may join the adjacent container cavity partitions 12. Therefore, each container cavity 15 may be defined by and between each pair of adjacent container cavity partitions 12 and the intervening partition connecting wall 13. In the illustrative embodiment which is illustrated in FIG. 4, six container cavities 15 are provided in the carousel body 10 in adjacent relationship with respect to each other around the circumference of the carousel base 9. In other embodiments, the container cavities 15 arranged around the carousel base 9 may be fewer or greater than six in number. A container arm slot 14 may be provided in the upper edge of the partition connecting wall 13 at each container cavity 15 for purposes which will be hereinafter described. A carousel body top panel 11 may be recessed in the carousel body 10.

The carousel base 9 of the medicine container carousel 8 may be attached to the base plate 3 of the carrier base 2 according to any suitable attachment technique known by those skilled in the art. In some embodiments, an annular base flange 4 may extend upwardly from the base plate 3. A companion flange groove (not illustrated) provided in the lower surface of the carousel base 9 may receive the base flange 4. A rotatable base disk 5 having disk splines 6 may be provided at the center portion of the base plate 3. The disk splines 6 may engage companion splines (not illustrated) provided on the bottom surface of the carousel base 9. Accordingly, as the medicine container carousel 8 is rotated with respect to the carrier base 2, the base disk 5 and disk splines 6 on the base plate 3 rotate with the carousel base 9 and the base flange 4 rotates in the flange groove (not illustrated) provided in the lower surface of the carousel base 9. In other embodiments, the carousel base 9 of the medicine container carousel 8 may be fixedly attached to the base plate 3 of the carrier base 2 according to the knowledge of those skilled in the art. In some embodiments, base feet 7 (FIG. 3) may be provided on the lower surface of the base plate 3 of the base 2.

Figure 11:
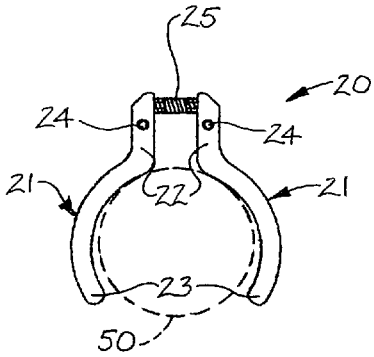
FIG. 11 is a top view of a container engaging assembly of an illustrative embodiment of the medicine container carrier, with a container (illustrated in phantom) inserted between a pair of container engaging arms of the container engaging assembly.

Referring next to FIGS. 4, 8, 9 and 11-13 of the drawings, multiple container engaging assemblies 20 may be provided on the carousel body 10 of the medicine container carousel 8. Each container engaging assembly 20 interfaces with a corresponding container cavity 15 provided in the carousel body 10 of the medicine container carousel 8. Accordingly, each container engaging assembly 20 is adapted to receive and engage a medicine container 50 which is inserted into the corresponding container cavity 15, as illustrated in FIG. 11 and typically in a manner which will be hereinafter described.

Figure 8:
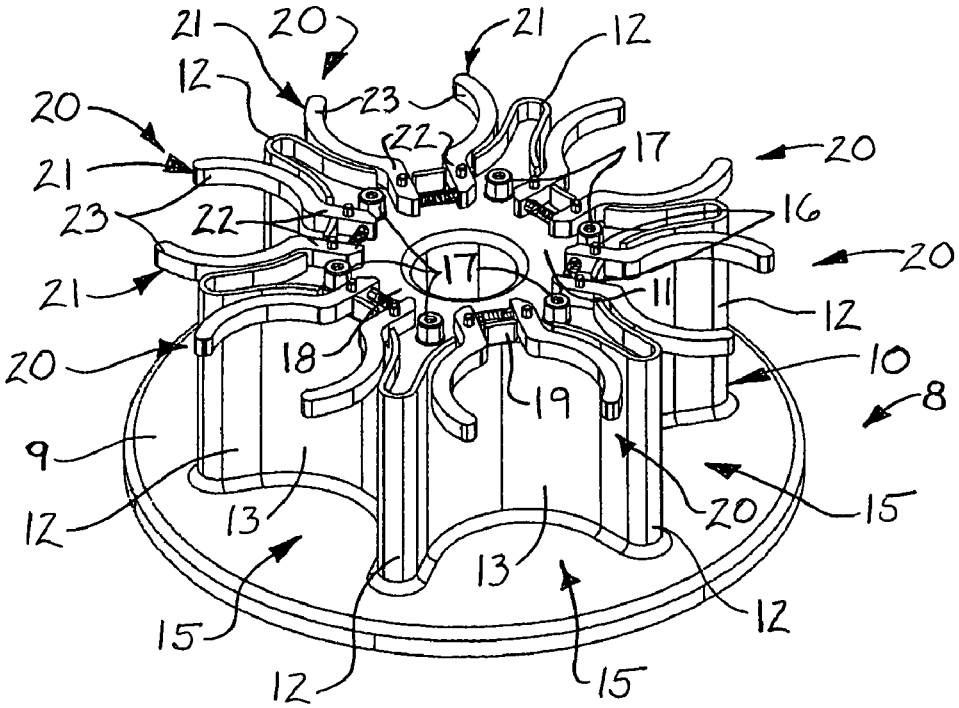
FIG. 8 is a perspective view of a medicine container carousel of an illustrative embodiment of the medicine container carrier, with multiple container engaging assemblies provided on the medicine container carrier.
Figure 12:
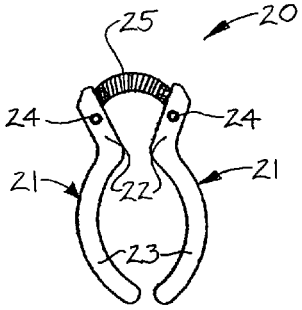
FIG. 12 is a top view of the container engaging assembly with the container engaging arms disposed in an inwardly-extended configuration.
Figure 13:
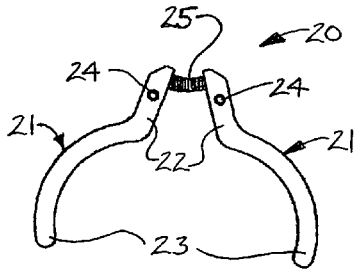
FIG. 13 is a top view of the container engaging assembly with the container engaging arms disposed in an outwardly-extended configuration.

As illustrated in FIGS. 11-13, each container engaging assembly 20 may include a pair of generally elongated, adjacent, spaced-apart container engaging arms 21. Each container engaging arm 21 may include an arm attachment segment 22, which may be attached to the carousel body 10 in a manner which will be hereinafter described, and a container engaging segment 23 which extends from the arm attachment segment 22. In some embodiments, an arm spring 25 may extend between the arm attachment segments 22 of the container engaging arms 21 for purposes which will be hereinafter described. The container engaging segment 23 of each container engaging arm 21 may have a generally curved shape. As illustrated in FIG. 8, the container engaging segments 23 of the respective container engaging arms 21 in each container engaging assembly 20 may be disposed generally in the upper portion of each corresponding container cavity 15.

Figure 9:
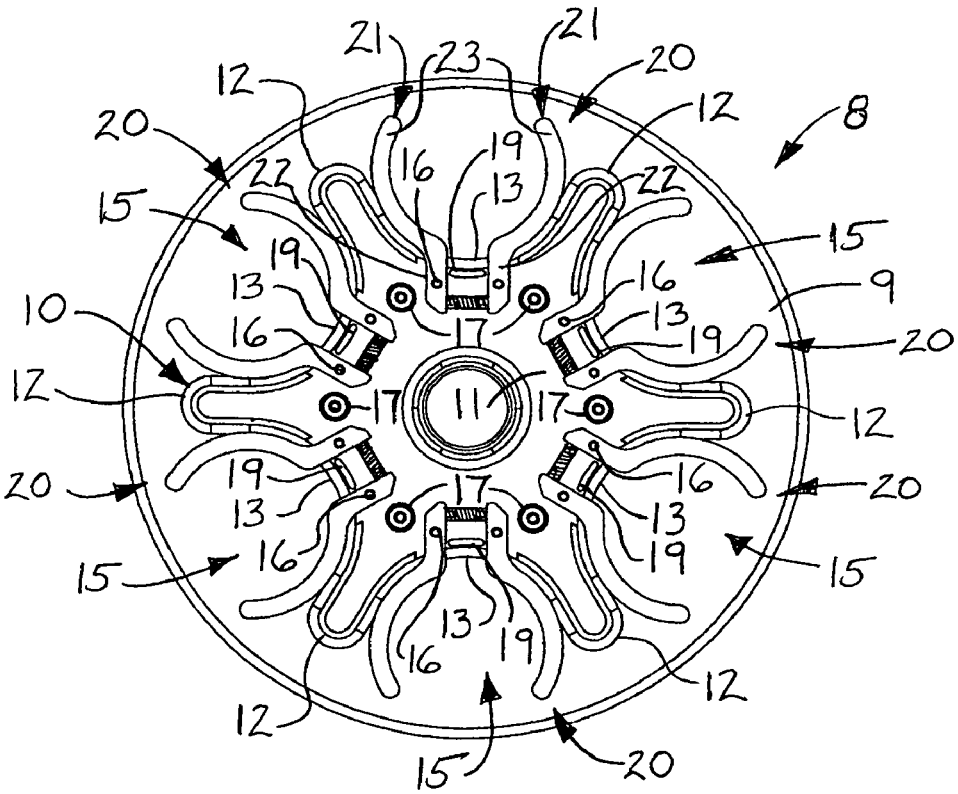
FIG. 9 is a top view of the medicine container carousel and container arm assemblies illustrated in FIG. 8.
Figure 10:
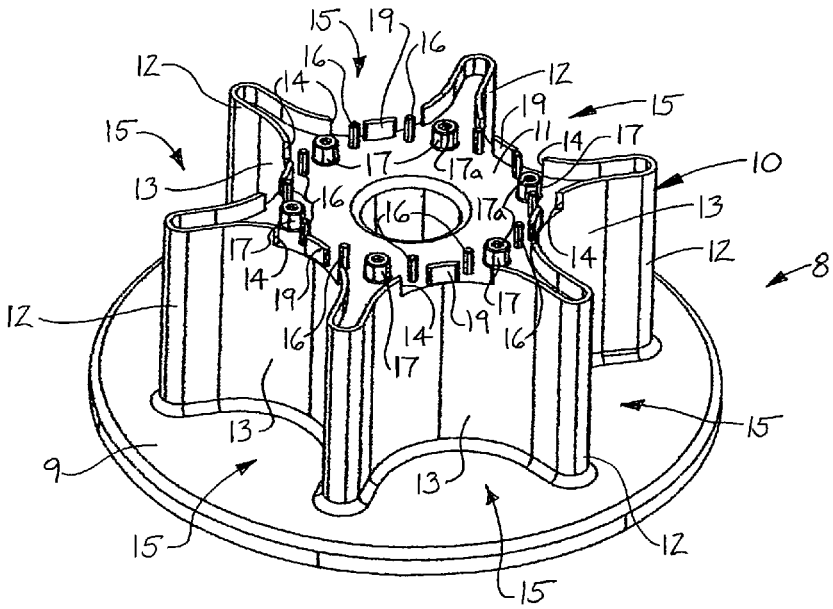
FIG. 10 is a perspective view of the medicine container carousel with the container arm assemblies omitted from the medicine container carousel.

The container engaging arms 21 of each container engaging assembly 20 may be attached to the carousel body 10 of the medicine container carousel 8 according to any suitable technique which is known by those skilled in the art. In some embodiments, the container engaging arms 21 of each container engaging assembly 20 may be pivotally attached to the carousel body 10. Accordingly, as illustrated in FIG. 10, a pair of spaced-apart container arm mount pins 16 may extend from the carousel body top panel 11 of the carousel body 10 generally adjacent to each container arm slot 14. As illustrated in FIGS. 11-13, a pin opening 24 may be provided in the arm attachment segment 22 of each container engaging arm 21. As illustrated in FIGS. 8 and 9, each pair of container arm mount pins 16 is extended through the pin openings 24 in the respective container engaging arms 21 of each container engaging assembly 20. Accordingly, the arm spring 25 which extends between the arm attachment segments 22 of the container engaging arms 21 normally maintains the container engaging arms 21 in the intermediate-width position illustrated in FIG. 11. The container engaging arms 21 can be selectively pivoted with respect to the container arm mount pins 16 and against the bias imparted by the arm spring 25 inwardly to the narrow position illustrated in FIG. 12 and outwardly to the broad position illustrated in FIG. 13. Thus, medicine containers 50 (FIG. 3) of various diameters can be inserted between the container engaging segments 23 of the respective container engaging arms 21 as the arm spring 25 biases the container engaging segments 23 against the medicine container 50. The curvature of the container engaging segment 23 of each container engaging arm 21 may generally match the curvature of the medicine container 50 to ensure a snug fit of the medicine container 50 between the container engaging arms 21, as illustrated in phantom in FIG. 11. As illustrated in FIG. 8, in some embodiments an arm divider 19 may extend upwardly from the carousel body top panel 11 of the carousel body 10, between the arm attachment segments 22 of the respective container engaging arms 21.

Referring next to FIGS. 4-7 of the drawings, a carousel cap assembly 26 may be provided on the carousel body 10 of the medicine container carousel 8. The carousel cap assembly 26 may include a circular cap assembly base 27 having a base plate 28. Multiple base cavities 29, each defined within a shaped cavity wall 29*a* extending from the base plate 28, are provided in spaced-apart relationship with respect to each other around the circumference of the cap assembly base 27. The base cavities 29 in the cap assembly base 27 correspond in number and position to the respective container cavities 15 provided in the carousel body 10 of the medicine container carousel 8. Base cavity partitions 30 may extend from the cavity walls 29*a* between each pair of adjacent base cavities 29. Each container engaging assembly 20 may be disposed within a corresponding base cavity 29 of the cap assembly base 27. A cap assembly flange 31 may extend upwardly from the base plate 28 and the cavity walls 29*a* of the base cavities 29. Wheel slots 32 may be provided in the cap assembly flange 31 at the respective base cavities 29 for purposes which will be hereinafter described.

Figure 5:
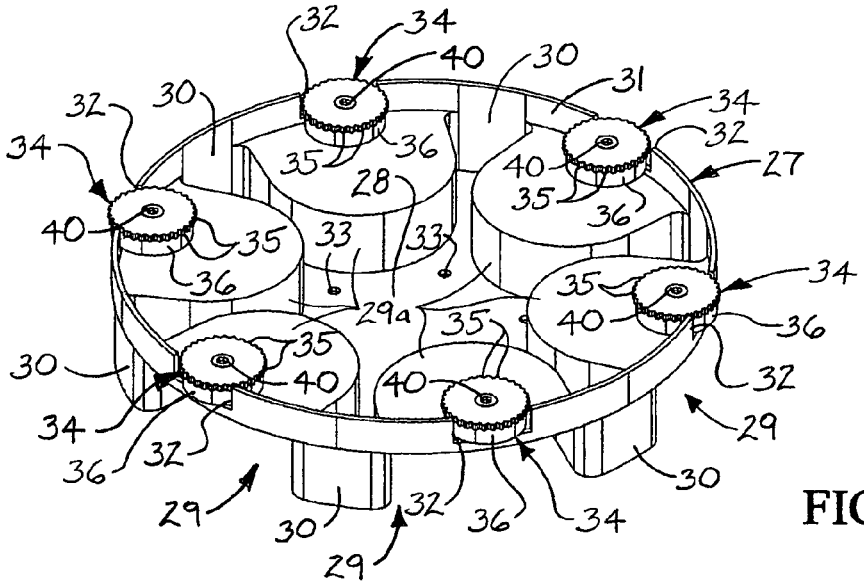
FIG. 5 is a perspective view of a cap assembly base of a cap assembly component an illustrative embodiment of the medicine container carrier with visual reminder wheels.

The cap assembly base 27 of the carousel cap assembly 26 may be attached to the carousel body 10 of the medicine container carousel 8 according to any suitable technique which is known by those skilled in the art. As illustrated in FIGS. 4 and 10, in some embodiments multiple spacers 17, each having an interiorly-threaded spacer cavity 17*a* (FIG. 10), are provided on the carousel body top panel 11 of the carousel body 10. As illustrated in FIGS. 5 and 10, multiple fastener openings 33 are provided in the base plate 28 of the cap assembly base 27. The fastener openings 33 correspond in number and position to the interiorly-threaded spacer cavities 17*a* provided in the respective spacers 17 on the carousel body 10. Accordingly, fasteners (not illustrated) may be extended through the respective fastener openings 33 in the base plate 28 of the cap assembly base 27 and threaded into the spacer cavities 17*a* provided in the respective spacers 17 to fasten the cap assembly base 27 to the carousel body 10. In other embodiments, the cap assembly base 27 may be molded in one piece with the carousel body 10 or attached to the carousel body 10 according to alternative attachment techniques known by those skilled in the art. When the cap assembly base 27 is provided on the carousel body 10, as illustrated in FIGS. 1 and 3, the spacers 17 maintain the cap assembly base 27 of the carousel cap assembly 26 in elevated or spaced-apart relationship with respect to the carousel body top panel 11 of the carousel body 10.

Figure 6:
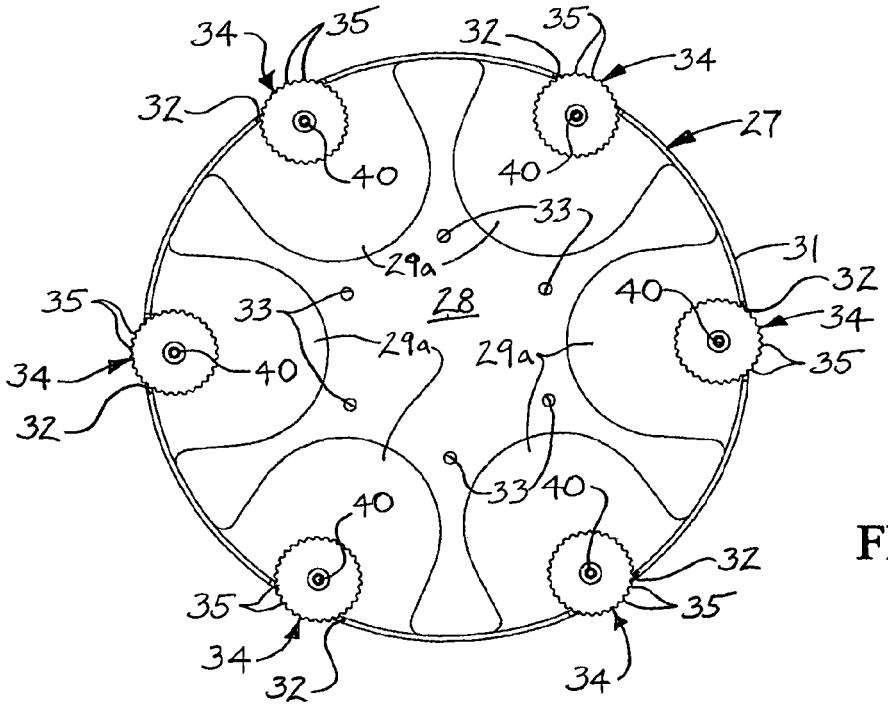
FIG. 6 is a top view of the cap assembly base with visual reminder wheels illustrated in FIG. 5.
Figure 7:
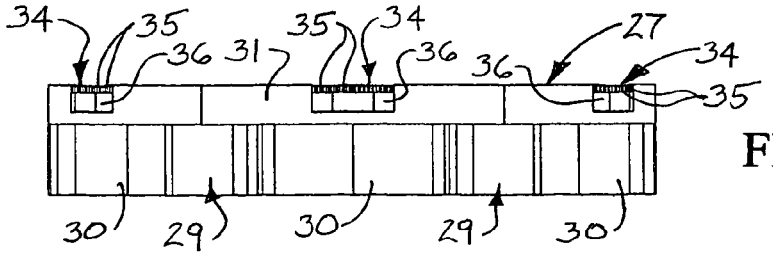
FIG. 7 is a side view of the cap assembly base with visual reminder wheels.

As illustrated in FIGS. 4-6, a rotatable visual reminder wheel 34 on which may be imprinted words, letters, symbols or labels may be provided at each base cavity 29 in the cap assembly base 27 of the carousel cap assembly 26. As illustrated in FIGS. 3, 4 and 5, each visual reminder wheel 34 may have multiple circumferential grip teeth 35 and a cylindrical visual reminder surface 36. As further illustrated in FIG. 4, an upward-standing wheel mount member 40 may be provided on the cavity wall 29*a* of each base cavity 29. A central wheel opening 37 (FIG. 4) provided in each visual reminder wheel 34 may receive each corresponding wheel mount member 40 to rotatably attach each visual reminder wheel 34 to the cavity wall 29*a* of each corresponding base cavity 29. As illustrated in FIG. 5, each visual reminder wheel 34 may be positioned in such a manner that the visual reminder wheel 34 protrudes through the corresponding wheel slot 32 provided in the cap assembly flange 31.

As illustrated in FIG. 4, the carousel cap assembly 26 may further include a cap plate 44 which is provided on the cap assembly base 27. The cap plate 44 may be attached to the cap assembly base 27 according to any suitable technique which is known by those skilled in the art. In some embodiments multiple fastener openings 45 are provided in spaced-apart relationship to each other around the circumference of the cap plate 44. Cap plate fasteners 48 (FIG. 2) are extended through the respective fastener openings 45 and threaded into respective registering fastener openings (not numbered) provided in the respective wheel mount members 40 to attach the cap plate 44 to the cap assembly base 27. In other embodiments, the cap plate 44 may be molded in one piece with the cap assembly base 27 or attached to the cap assembly base 27 according to alternative attachment techniques known by those skilled in the art.

A handle 47 may be attached to the cap plate 44 to facilitate carrying of the medicine container carrier 1. In some embodiments, a handle cavity 46 may be provided in the cap plate 44 and the handle 47 may be pivotally attached to opposite interior edges of the handle cavity 46. Accordingly, the handle 47 can be selectively pivoted into the handle cavity 46 to lie flush with the cap plate 44, as illustrated in FIGS. 1-3A, or may be selectively extended from the handle cavity 46 and grasped to carry the medicine container carrier 1. Multiple carrier mount slots 49 may be provided in the cap plate 44 for purposes which will be hereinafter described.

Referring next to FIGS. 1-3A of the drawings, in typical use of the medicine container carrier 1, each of multiple medicine containers 50 (FIG. 3) is inserted between the container engaging arms 21 of a corresponding container engaging assembly 20 in each corresponding container cavity 15 of the medicine container carousel 8. Each medicine container 50 contains a supply of medication (not illustrated) typically in the form of capsules, tablets or pills. In some applications, the medicine containers 50 may contain a supply of liquid medication. A removable medicine container cap 51 may be provided on each medicine container 50. A medicine container label 52 may be provided on each medicine container 50. Information regarding the type of medication which is stored in the medicine container 50, as well as the indications or dosage of the medication, is typically printed on the medicine container label 52. As illustrated in FIG. 3, each medicine container 50 may be oriented in the corresponding container cavity 15 in such a manner that the medicine container label 52 on the medicine container 50 is visible to an external observer of the medicine container carrier 1.

Figure 3A:
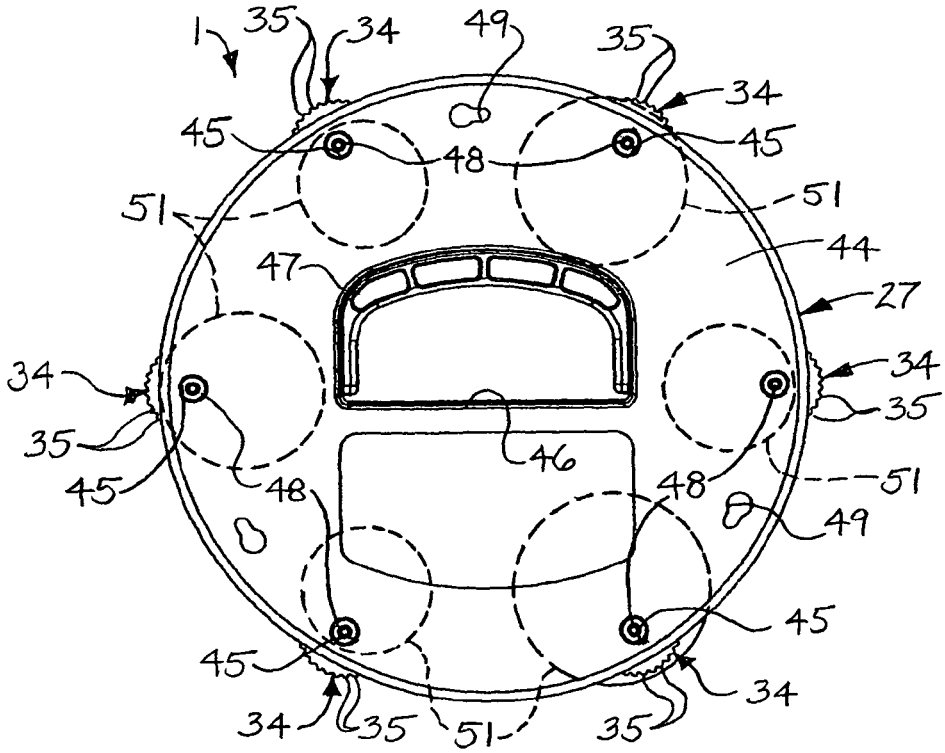
FIG. 3A is a top view of an illustrative embodiment of the medicine container carrier, with multiple medicine containers (illustrated in phantom) in multiple shapes and sizes provided in the medicine container carrier.

As each medicine container 50 is inserted into a corresponding container cavity 15 of the medicine container carousel 8, the curved configuration of the container engaging segments 23 (FIGS. 11-13) on the container engaging arms 21 of each container engaging assembly 20 facilitates a generally congruent fit of the medicine container 50 between the container engaging arms 21. As illustrated in FIG. 3A, it will be appreciated by those skilled in the art that the pivoting action of the container engaging arms 21 of each container engaging assembly 20, which was heretofore described with respect to FIGS. 11-13, enables placement of medicine containers 50 (illustrated in phantom) having various diameters in the respective container cavities 15 of the medicine container carousel 8.

Figure 14:
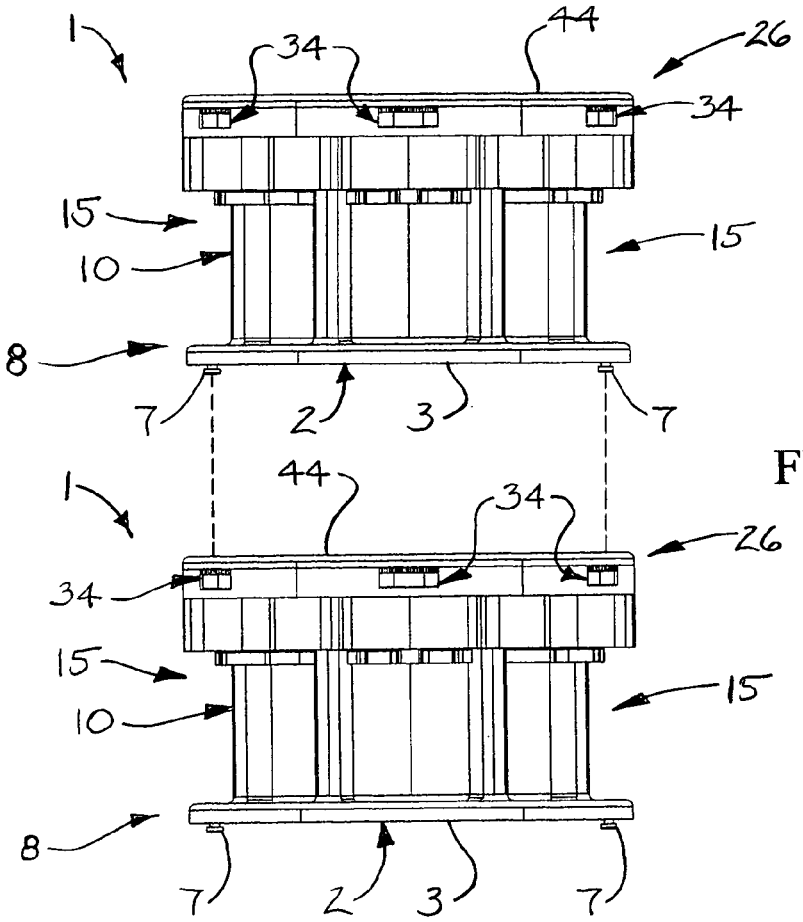
FIG. 14 is an exploded side view of a pair of medicine container carriers, more particularly illustrating stacking of the medicine container carriers.
Figure 15:
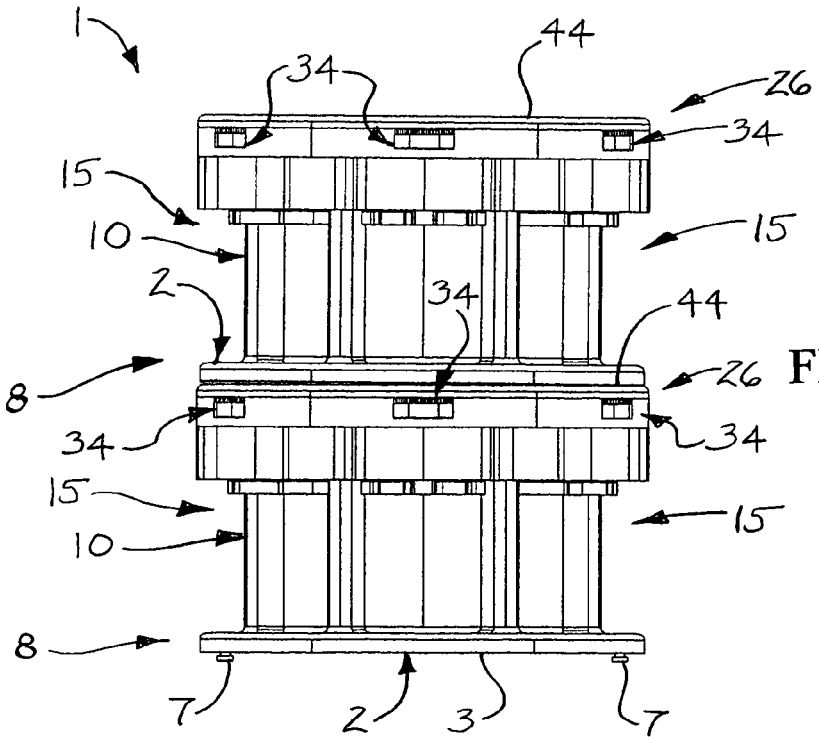
FIG. 15 is a side view of a pair of stacked medicine container carriers.

Referring next to FIGS. 14 and 15 of the drawings, in some applications multiple units of the medicine container organizer 1 can be stacked on top of each other to increase the organization, storage, coordination and transport capacity of the medicine container organizers 1. The upper medicine container organizer 1 can be selectively attached to the lower medicine container organizer 1 by initially aligning the base feet 7 provided on the base plate 3 of the organizer base 2 of the upper medicine container organizer 1 with the respective organizer mount slots 49 (FIG. 1) provided in the cap plate 44 of the carousel cap assembly 26 on the lower medicine container organizer 1, as illustrated in FIG. 14. Each base foot 7 on the upper medicine container organizer 1 is then inserted into the wide portion of each corresponding organizer mount slot 49 (FIG. 1), after which the upper medicine container organizer 1 or the lower medicine container organizer 1 can then be rotated to locate each base foot 7 into the narrow portion of the corresponding organizer mount slot 49. This causes the base feet 7 of the upper medicine container organizer 1 to interlock with the respective organizer mount slots 49 of the lower medicine container organizer 1 and attach the medicine container organizers to each other, as illustrated in FIG. 15. The upper medicine container organizer 1 can be selectively detached from the lower medicine container organizer 1, as desired, by reversing the steps described above. A selected number of the medicine container organizers 1 can be stacked on each other typically in the manner which was heretofore described.

Figure 16:
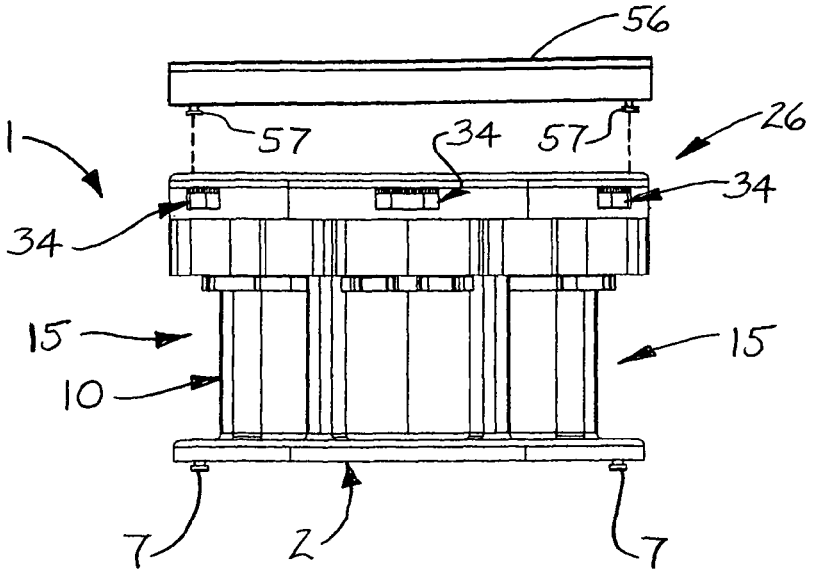
FIG. 16 is an exploded side view illustrating attachment of a support tray to the medicine container carrier.

Referring next to FIG. 16 of the drawings, in some embodiments, one or multiple support trays 56 for supporting supplies (not illustrated) or the like may be stacked on each medicine container organizer 1. Each support tray 56 may be attached to the underlying medicine container organizer 1 by inserting tray feet 57 which extend from the support tray 56 into the respective organizer mount slots 49 (FIG. 1) provided in the cap plate 44 of the carousel cap assembly 26 on the medicine container organizer 1. In some embodiments, mount slots (not illustrated) which are similar to the organizer mount slots 49 (FIG. 1) provided in the cap plate 44 of the medicine container organizer 1 may be provided in each support tray 56 to facilitate stacking of a selected number of the support trays 56 on each other and increase the item-carrying or supply-carrying capacity of the medicine container organizer 1.

Figure 17:
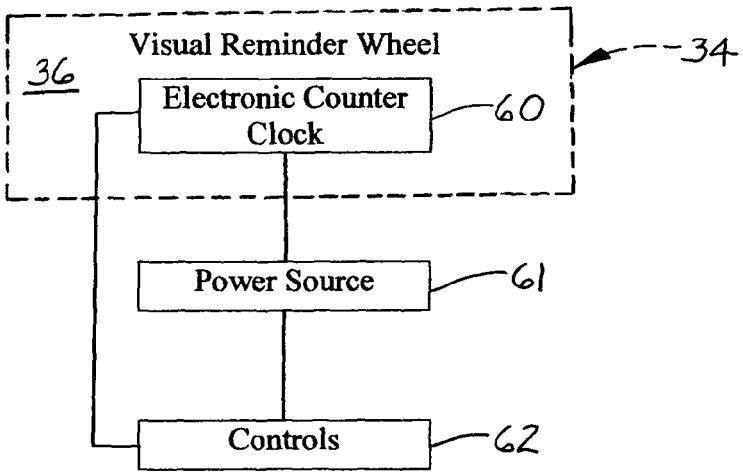
FIG. 17 is a schematic block diagram of an exemplary electronic counter clock which is suitable for implementation of some embodiments of the medicine container carrier.

Referring next to FIG. 17 of the drawings, in some applications of the medicine container carrier 1, at least one electronic counter clock 60 may be provided on the visual reminder surface 36 of each visual reminder wheel 34 above each container cavity 15. A power source 61 such as at least one battery, for example and without limitation, and controls 62 may be connected to the electronic counter clock 60. Information about the medication which is contained in the medicine container 50 that is inserted in the container cavity 15 corresponding to the visual reminder wheel 34 on which the electronic counter clock is provided may be displayed on the visual reminder surface 36 such as by actuation of the controls 62. The information provided on the electronic counter clock 60 may include such information as the number of capsules, tablets or pills in the medicine container 50 which are to be taken by a patient at each administration of the medication; the time or times at which the medication is to be taken; and/or the order in which the medication is to be taken in relation to the medication that is contained in the remaining medicine containers 50 in the other container cavities 15. In some applications, the order in which the medicine containers 50 are placed in the container cavities 15 around the circumference of the medicine container carrier 1 may correspond to the order in which the medications in the respective medicine containers 50 are to be taken throughout the day, for example and without limitation. The order number of the medication in each medicine container 50 may be indicated on the electronic counter clock 60 which is provided on the visual reminder surface 36 of each visual reminder wheel 34. Each visual reminder wheel 34 may be selectively rotated to increase the quantity of information which can be displayed on the visual reminder surface 36.

It will be appreciated by those skilled in the art that the information which is provided on the medicine container label 52 of each medicine container 50, as well as the information which may be printed, inscribed or otherwise provided on the visual reminder surface 60 of each visual reminder wheel 34 in some embodiments or provided on the electronic counter clock 60 on the visual reminder surface 36 of each visual reminder wheel 34 in some embodiments, aids a patient or a patient caregiver in scheduling, coordination and administration of the medications which are contained in the medicine containers 50 in the prescribed order and at the prescribed dosages and times. Proper administration of the medications may improve patient outcomes, increase patient compliance and expedite patient recovery while reducing the possibility of accidental overdose, potential adverse effects, ineffective drug therapy, side effects and drug interactions, duplicate drug therapy or missed administration of one or more of the medications. The medicine container carrier 1 may assist patients with chronic diseases in adapting to physical limitations by enabling prioritization of the medication. The design of the medicine container carrier 1 enables the display and clear visibility of the information printed on the medicine container label 52 and on the visual reminder surface 36 of each visual reminder wheel 34, assisting a patient or a patient caregiver in the correct administration of the medications and increasing knowledge of medications. It will be further appreciated by those skilled in the art that the medications may be contained in the original medicine container 50 in which the medication was dispensed in use of the medicine container carrier 1 to organize, store, coordinate and transport the medications.

It will be further appreciated by those skilled in the art that the medicine container carrier 1 may be constructed of a lightweight plastic material which renders the medicine container carrier easily transportable such as by grasping of the handle 47. Materials which are suitable for fabrication of the medicine container carrier 1 include but are not limited to plastics such as acrylic or polypropylene, for example and without limitation. The medicine container carrier 1 may be fabricated of any suitable material by molding, fabrication or other conventional manufacturing techniques. Portability of the medicine container carrier 1 facilitates ease of transport of the medicine container carrier 1 within and outside a home setting (such as from room to room, trips to the doctor's office or travel abroad, for example). Moreover, multiple medicine container carriers 1 can be selectively stacked or interlocked to increase the number of medicine containers 50 which can be organized and/or carried, as was heretofore described with respect to FIGS. 14 and 15. In some applications, the stacked medicine container carriers 1 can be attached to each other by initially inserting the base feet 7 (FIG. 3) provided on the carousel base 9 of one medicine container carrier 1 into the wide portions (not numbered) of the respective carrier mount slots 49 (FIGS. 1, 2 and 4) and then rotating one medicine container carrier 1 with respect to the other to transition the base feet 7 into the narrow portions (not numbered) of the respective carrier mount slots 49.

While the embodiments of the disclosure have been described above, it will be recognized and understood that various modifications can be made and the appended claims are intended to cover all such modifications which may fall within the spirit and scope of the disclosure.

What is claimed is:

1. A medicine container carrier, comprising:

a carrier base;

a medicine container carousel having a carousel base carried by said carrier base, a carousel body carried by said carousel base and a plurality of container cavities in said carousel body;

wherein said carousel body comprises a plurality of container cavity partitions extending from said carousel base and a plurality of concave partition connecting walls connecting said plurality of container cavity partitions;

wherein said plurality of container cavities is defined by and between said plurality of container cavity partitions and said plurality of concave partition connecting walls; and a plurality of container engaging assemblies carried by said medicine container carousel at said plurality of container cavities, respectively.

2. The medicine container carrier of claim 1 wherein said medicine container carousel rotates with respect to said carrier base.

3. A medicine container carrier, comprising:

a carrier base;

a medicine container carousel having a plurality of container cavities carried by said carrier base;

a plurality of container engaging assemblies carried by said medicine container carousel at said plurality of container cavities, respectively;

wherein each of said plurality of container engaging assemblies comprises a pair of container engaging arms pivotally carried by said medicine container carousel; and wherein said pair of container engaging arms comprises a pair of arm attachment segments pivotally carried by said medicine container carousel and a pair of generally curved container engaging segments extending from said pair of arm attachment segments, respectively.

4. A medicine container carrier, comprising:

a carrier base;

a medicine container carousel having a plurality of container cavities carried by said carrier base;

a plurality of container engaging assemblies carried by said medicine container carousel at said plurality of container cavities, respectively;

wherein each of said plurality of container engaging assemblies comprises a pair of container engaging arms pivotally carried by said medicine container carousel;

wherein said pair of container engaging arms comprises a pair of arm attachment segments pivotally carried by said medicine container carousel and a pair of generally curved container engaging segments extending from said pair of arm attachment segments, respectively; and an arm spring interposed between said pair of arm attachment segments.

5. A medicine container carrier, comprising:

a carrier base;

a medicine container carousel having a plurality of container cavities carried by said carrier base;

a plurality of container engaging assemblies carried by said medicine container carousel at said plurality of container cavities, respectively;

a carousel cap assembly carried by said medicine container carousel;

wherein said carousel cap assembly comprises a cap assembly base and a cap plate carried by said cap assembly base; and a plurality of base cavities provided in said cap assembly base and communicating with said plurality of container cavities, respectively, of said medicine container carousel and wherein said plurality of container engaging assemblies is disposed in said plurality of base cavities, respectively.

6. The medicine container carrier of claim 5 further comprising a handle carried by said cap plate.

7. The medicine container carrier of claim 6 further comprising a handle cavity provided in said cap plate and wherein said handle is pivotally carried by said cap plate in said handle cavity.

* * * * *